United States Patent [19]

Hayward

[11] Patent Number: 4,766,419

[45] Date of Patent: Aug. 23, 1988

[54] APPARATUS FOR RECORDING THE OPERATION OF A CLOSURE MEMBER

[75] Inventor: Gilbert O. Hayward, Dyfed, Wales

[73] Assignee: Enigma Electronics Limited, Middlesex, England

[21] Appl. No.: 826,193

[22] Filed: Feb. 5, 1986

[30] Foreign Application Priority Data

Feb. 5, 1985 [GB] United Kingdom ..... 8502857
Oct. 23, 1985 [GB] United Kingdom ..... 8526147

[51] Int. Cl.[4] ..... G08B 13/08

[52] U.S. Cl. ..... 340/545; 340/568; 70/434

[58] Field of Search ..... 340/545, 572, 541–543, 340/531, 568; 116/12, 14; 70/432, 433, 434, 439, DIG. 59, 76, 93; 160/10; 109/38; 40/459, 460; 53/52, 54

[56] References Cited

U.S. PATENT DOCUMENTS 2,700,360 1/1955 Stegman .

FOREIGN PATENT DOCUMENTS 0141701 5/1985 European Pat. Off. .

2109109 5/1983 United Kingdom ..... 70/439

*Primary Examiner*—Joseph A. Orsino, Jr.
*Assistant Examiner*—Brian Tumm
*Attorney, Agent, or Firm*—Salter & Michaelson

[57] ABSTRACT

Apparatus for recording the opening or closing of a closure member, comprising a device for providing an electrical signal on opening or closing of the closure member or on actuation of an ancillary device associated with opening or closing of the closure member, an electronic circuit adapted to generate one of a number of unique codes on receipt of the electrical signal and to store the generated code, and a display device for displaying the generated code. In one form of the invention a reusable seal for a vehicle or container comprises a housing, and a cable secured at one end to the housing and releasably attached to the housing at the other end by a locking mechanism. Operation of the locking mechanism causes an electronic circuit in the housing to generate a random number, which is displayed by an LED display when a button is pressed. Any change in the number displayed indicates that the cable has been released. The seal can be used in the same way and can be repeatedly re-used.

12 Claims, 5 Drawing Sheets

APPARATUS FOR RECORDING THE OPERATION OF A CLOSURE MEMBER

BACKGROUND OF THE INVENTION

This invention relates to apparatus for recording the opening or closing or a closure member.

More particularly, the invention relates to apparatus for recording the opening or closing of a closure member such as a door controlling access to an enclosed space. The invention is particularly, though not exclusively, concerned with goods vehicles such as closed lorries or vans.

When goods vehicles are loaded they are usually sealed at the point of dispatch by means of a metal or wire seal which passes through the door or shutter catch. Each seal has stamped on it a unique number which is recorded on the driver's delivery documents. At the point of delivery the number on the seal is compared with that on the documents to check whether the vehicle has been opened. This system has a number of disadvantages. Some mechanical seals can be "locked" to appear sealed when in fact they are not. The seals can only be used once, and so add to the expense of vehicle operation. Moreover, to have numerous stocks of seals at all the locations a vehicle may visit is costly and reduces the security of the system as the allocation of the seals must be carefully controlled.

U.S. Pat. No. 4,118,047 describes a reusable seal consisting of a body and a wire loop, the ends of which pass through holes in the body and are clamped in position by plungers actuated by turning a drum rotatably mounted in the body. One side of the drum forms a tray containing a large number of balls of different colours, and rotating the drum to the clamping position moves five of the balls into a recess in the body, in which they are visible from outside the body. The five visible balls provide a colour code which is changed if the drum is rotated to release and unclamp the wire loop, so giving an indication that the seal has been tampered with. This provides a reusable seal, but requires a complex mechanism.

It is an object of this invention to provide apparatus which can be used instead of mechanical seals, and which can be manufactured simply and inexpensively.

SUMMARY OF THE INVENTION

This invention consists of an apparatus for recording the opening or closing of a closure member, comprising means for providing an electrical signal on opening or closing of the closure member or on actuation of an ancillary device associated with opening or closing of the closure member, an electronic circuit adapted to generate one of a number of unique codes on receipt of the electrical signal and to store the generated code, and display means adapted to display the generated code.

Preferably, the electronic circuit is adapted to generate a random code on receipt of the electrical signal.

For example the code may be random or quasi-random number.

The display means may, for example, be an LED or LCD display.

In one form of the invention, the apparatus consists of a housing, containing the electronic circuit and display means, an extending member attached at one end to the housing or to the closure member and adapted to be linked to a catch of the closure member so that the extending member must be withdrawn from the catch before the closure member can be opened, and attachment means for releasably attaching the other end of said member to the housing, the means for generating an electrical signal being responsive to operation of the attachment means to attach the extending member to or detach it from the housing.

When the invention is applied to a goods vehicle or container, the housing may be fixed to the outer face of the door or shutter of the vehicle or container, and the extending member may be a flexible element, such as a steel cable, which can be passed through the door or shutter catch, in a similar manner to a conventional seal, before being engaged with the housing. When the vehicle has been loaded and the door or shutter closed, the flexible cable is passed through the catch and secured in the housing by operation of the attachment means. This causes the electronic circuit to generate a random number which is stored by the electronic circuit. This number, as displayed by the display means, can be entered on the vehicle documents, so that, at the destination, the number entered on the documents can be checked against the number displayed, to ensure that the flexible cable has not been withdrawn to allow the door or shutter to be opened during the journey.

Since the next number to be generated on releasing the cable from the housing is unpredictable, the security of the system is high. Moreover, since the apparatus is mounted on the vehicle there is no need for stocks of seals to be kept at each collection and delivery point. The apparatus thus provides a cheaper and more secure system than the conventional system employing mechanical seals.

The housing may also contain a battery for energising the circuit. Preferably, the display means is actuated only when required, for example, on depression of a push button mounted on the housing.

In another form of the invention, the means for providing an electrical signal comprises a sensor adapted to sense movement of the closure member to an opened or a closed position. The electronic circuit then generates a new code automatically whenever the closure member is opened or closed. The electronic circuit can then be contained in a housing adapted to be mounted inside the space to be closed by the closure member, for example inside the door or shutter of a vehicle or container, with the display means mounted so as to be visible from outside. Alternatively, the housing could be mounted on the outer face of the door or shutter and connected to the sensor by a cable passing through a hole in the door or shutter.

The electronic circuit may include a free-running oscillator, a counter connected to the output of the oscillator, a means for storing the count of the counter at the instant the electrical signal is received, and a multi-digit display arranged to display the value of the stored count.

The apparatus of this invention could be used in other applications, for example in sealing bank vaults, security boxes, deed boxes or other containers where access is allowed only to authorised persons. The apparatus could be used to seal buildings, e.g. at night, the key holder who locks the building recording the number display by the apparatus. The number could be communicated to security patrols to enable them to check that the door has not been opened since the building was locked.

DESCRIPTION OF THE DRAWINGS

The invention will now be described, by way of example, with reference to the accompanying drawings, in which.

DESCRIPTION OF THE PREFERRED EMBODIMENT

Figure 1:
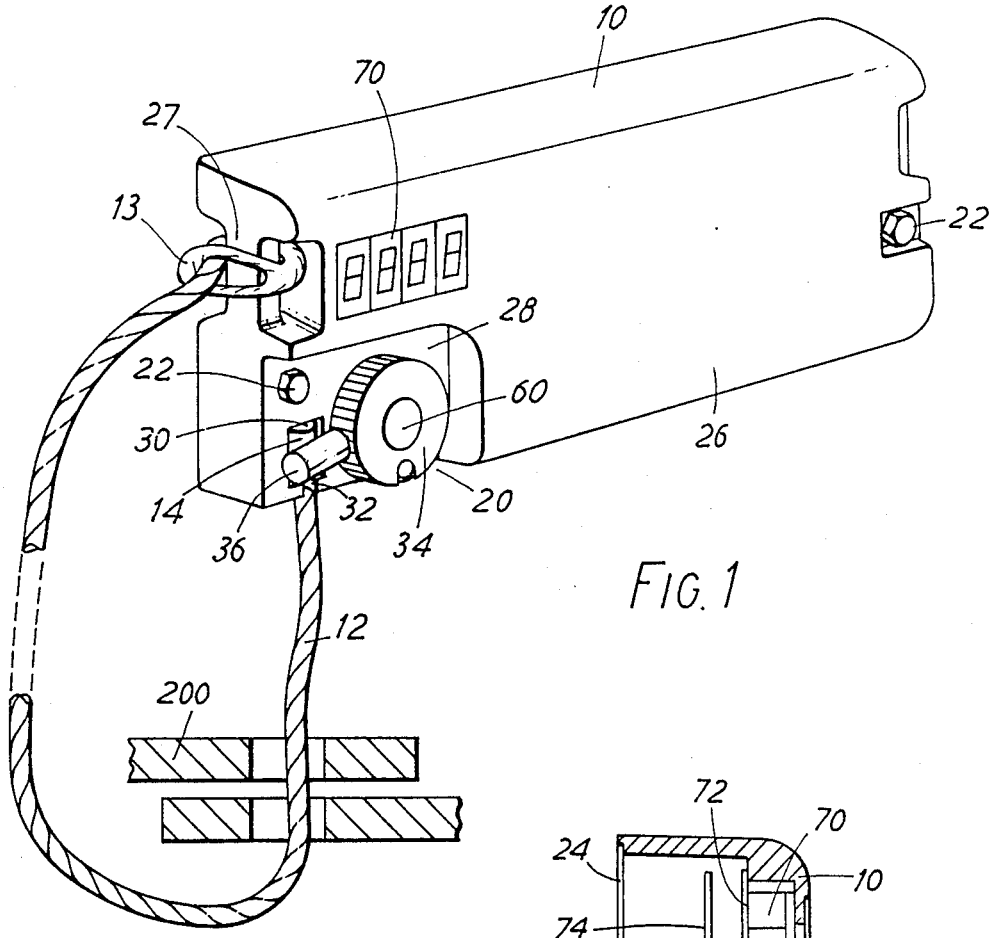
FIG. 1 is a perspective view of a reusable seal in accordance with the invention.
Figure 3:
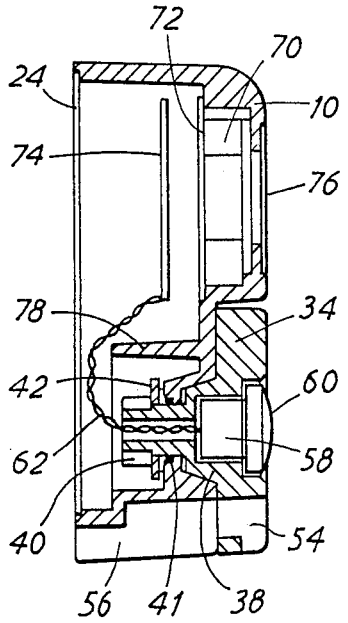
FIG. 3 is a section on line 111—111 of FIG. 2.
Figure 2:
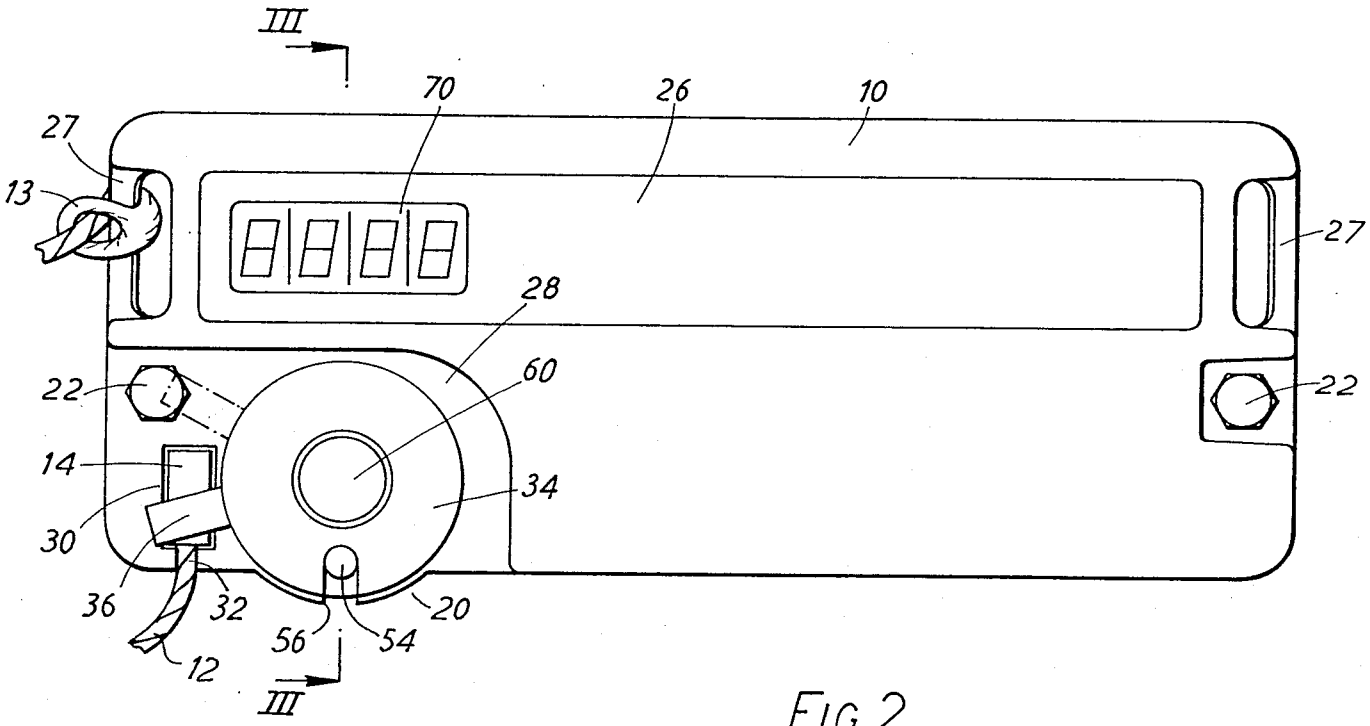
FIG. 2 is a front elevation of the seal.
Figure 4:
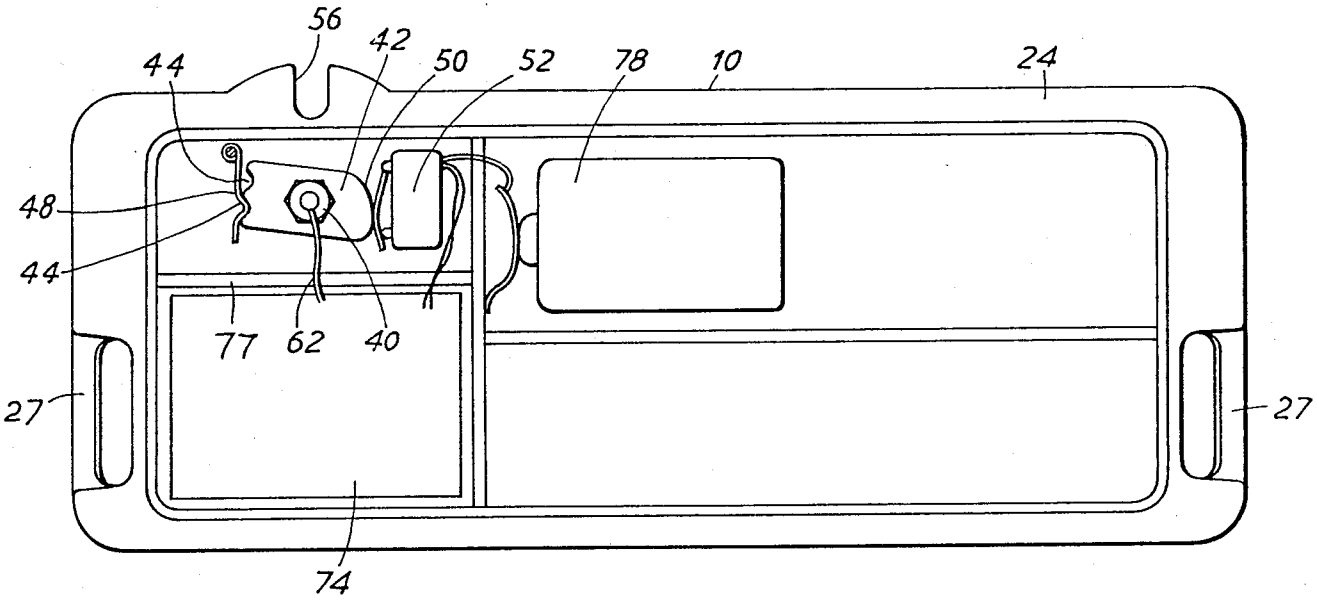
FIG. 4 is a rear view of the seal, with a cover of the housing removed.

FIGS. 1 to 5 illustrate a reusable seal, primarily for vehicles or containers, consisting of a housing 10 and a cable 12 permanently secured at one end to the housing and having at its other end a head 14 enabling it to be connected to the housing by means of a catch mechanism 20. The housing has a multi-digit display 70, which displays a number which is changed on each actuation of the catch mechanism 20, as described below.

The housing 10, which may be of diecast aluminium or other suitable material, is in the form of a shallow box. The housing can be secured to the outer face of the door or shutter of the vehicle or container, with the rear wall 24 of the housing lying flat against the door or shutter, by means of bolts 22, the heads of which are recessed into the front wall 26 of the housing. At each end of the housing is a bar 27, providing alternative attachment points for the cable 12. The cable 12, which may for example for a multi-stranded wire cable, is formed with a loop 13 at one end, by means of which it is secured to the housing, the cable passing around one of the bars 27 and through the loop 13. This method of securing the end of the cable to the housing enables the cable to be replaced, for example in the event of damage. The enlarged head at the other end of the cable 12 fits into a recess 30 in the front wall 26 of the housing 10. The recess 30 opens laterally through a slot 32 wide enough to accommodate the cable 12 but narrower than the head. The catch mechanism 20 consists of a knob 34 which is rotatably mounted on the front wall of the housing 10, so that it can be turned manually. A peg 36 projects outwards from the knob 34. The knob can be moved between two positions, in one of which the peg 36 extends over the recess 30 to trap the head 14 of the cable 12 in the recess and in the other of which (shown in broken lines in FIG. 2) the peg is clear of the recess so that the head can be moved into and out of the recess. The knob 34 has a shaft 38 which extends through an aperture in the front wall 26 and is retained by a nut 40. An O-ring 41 is provided to prevent moisture and dirt entering the housing.

A cam plate 42 is fixed to the shaft 38 so as to rotate with the shaft. On one side, the cam plate is formed with two recesses 44 which can be engaged by a spring detent 48 to define the two positions of the knob 34. On the other side, the cam plate 42 has a cam surface 50 which engages the actuating arm of a microswitch 52, mounted in the housing 10, so that the microswitch is actuated as the knob 34 moves from the release position to the locking position.

The knob 34 has a central recess housing a sealed electric switch 58 opposed by a push button 60 positioned in the centre of the knob. Depression of the push button 60 closes normally-open contacts of the switch. A pair of leads 62 extend from the switch 58 through a bore in the shaft 38 of the knob 34 to the interior of the housing 10.

The part 28 of the front wall 26 on which knob 34 is mounted is set back from the remainder of the front wall, so that the knob does not stand proud of the housing. The knob 34 has hole 54 which, when the knob is in the locking position, is aligned with a groove 56 in the bottom wall of the housing 10. This enables the knob to be secured in the locking position, for example by inserting a pin or the shackle of a padlock through the hole 54 to engage in the groove 56, to prevent the knob 34 from being moved inadvertently to the release position.

The electronic components of the apparatus are mounted on two printed circuit boards 72 and 74 fixed in the housing 10. The printed circuit board 72 carried the LED display 70, positioned behind a transparent window 76 in the front wall 26 of the housing 10. The compartment of the housing containing the printed circuit boards is separated from the compartment combining the microswitch 52 and the associated moving parts by a wall 77, so that the electronic components can be encapsulated by filling the compartment with a suitable potting material.

The remainder of the housing 10 forms a battery compartment containing a number of dry cells 78, which are permanently connected by leads to the electronic circuitry of the apparatus. The housing 10 has an opening in the base which is closed by a cover after assembly of the apparatus. The cover may be removable, to allow the dry cells 78 to be replaced. Alternatively, the dry cells may be potted and the cover may be permanently fixed in place to form a sealed-for-life unit.

Figure 5:
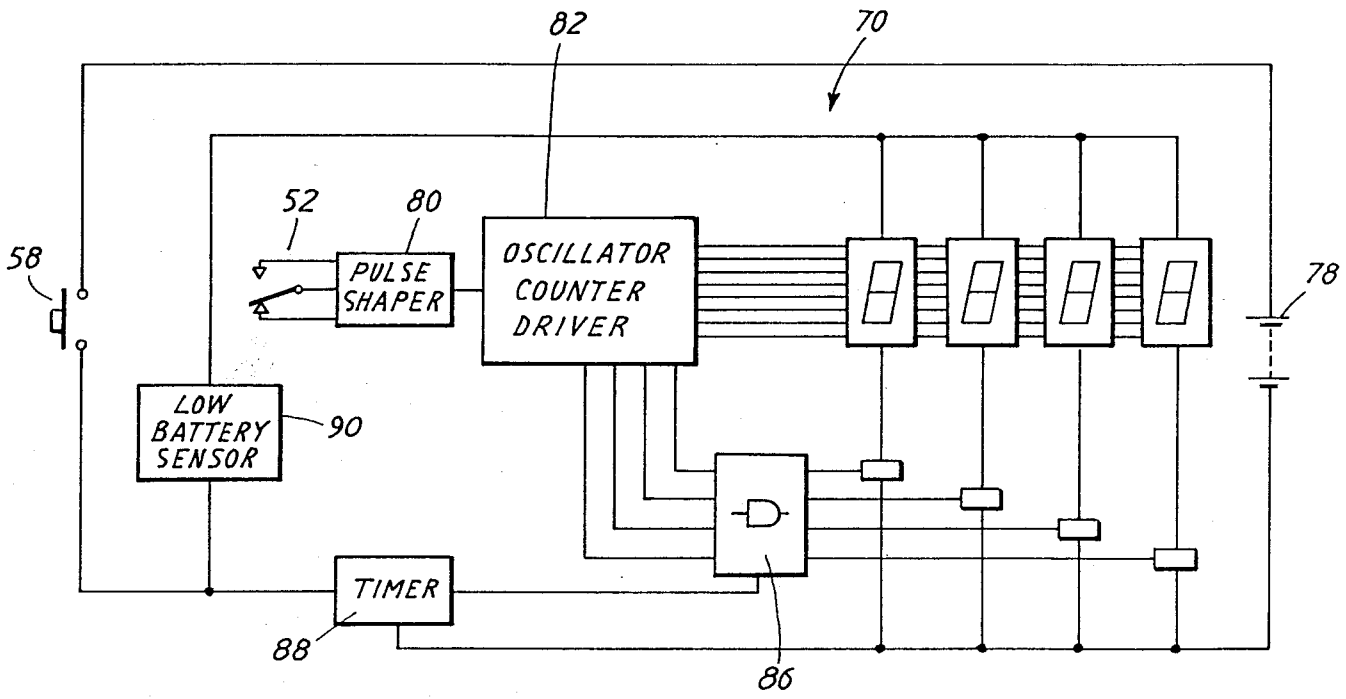
FIG. 5 is a block diagram of the electronic circuit of the seal.

As shown in FIG. 5, the microswitch 52 is connected to a pulse shaping circuit 80 which, on actuation of the microswitch, supplies an input signal pulse to an integrated circuit 82 which incorporates a free-running oscillator, counter and driver. The oscillator runs continuously, so that the counter, which is driven by the oscillator, counts repeatedly through a cycle from 0 to 9999. On receipt of the signal pulse from the pulse shaping circuit, the count of the circuit 82 is latched at the instantaneous count of the counter. The circuit thus acts as a random number generator, producing a random number as a result of each actuation of the microswitch 52, the number being stored in the circuit 82 until the next actuation of the microswitch. The output of the counter is supplied to the four-digit LED display 70. The display 70 is energised through four AND gates 86, which also receive an input from a timer 88 connected to the push-button switch 58, so that the display is enabled only for a pre-set time, say for five seconds after actuation of the push-button switch 58. A sensing circuit 90 is provided to sense when the battery voltage falls below a predetermined threshold and to give a warning display, for example by causing decimal points to appear on the display 70. The microswitch 52, cam plate 42 and knob 34 are so arranged that, when the knob is moved from the release position to the locking position, the microswitch is actuated before the knob reaches a point at which the head 14 will remain held in the recess 30 by the peg 36, to ensure that a new number is generated even if the knob is not moved fully to the locked position. This can be achieved by arranging for the microswitch to be actuated before the peg 36 reaches the recess 30, or before it reaches a point at which the spring detent will allow the knob 34 to remain in position without returning it to the release position.

The circuit can be arranged so that a new number is generated only when the knob 34 is moved to the locking position. Alternatively, the circuit can be arranged so that a new number is generated both when the knob is moved to the release position and also when it is moved to the locking position. In a further alternative, the device could be arranged to generate a new number only when the knob 34 moves to the release position, in which case it is necessary to ensure that the microswitch 52 operates before the head 14 is released. In use of the seal, after the vehicle or container has been loaded and the door or shutter closed, the free end of the cable 12 is detached from the housing 10 and passed through the door or shutter catch 200, in similar manner to a conventional wire seal, so that the door or shutter cannot be opened without withdrawing the cable. The free end of the cable is then reattached to the housing 10 and the knob 34 turned to the locking position. Turning the knob 34 actuates the microswitch 52 to cause a new random number to a be generated. Button 60 is pressed to display the number on the LED display 70, and the number is entered on the vehicle documents. When the vehicle has reached its destination, the button is again depressed and the number displayed checked against the number entered on the vehicle documents, to check that the seal has not been opened during the journey.

Figure 6:
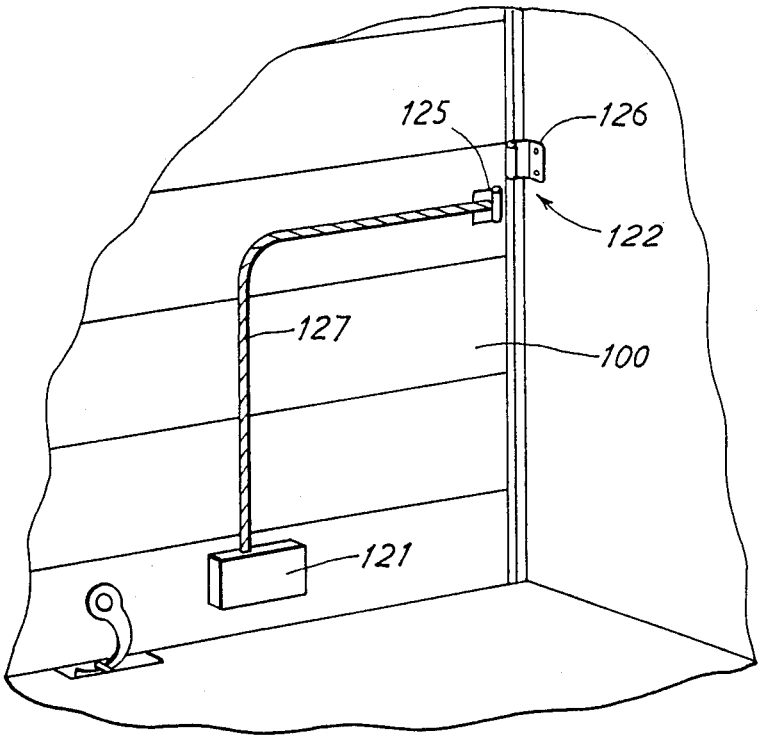
FIG. 6 is a partial view of the interior of a vehicle illustrating the mounting of apparatus in accordance with a second embodiment of the invention.
Figure 7:
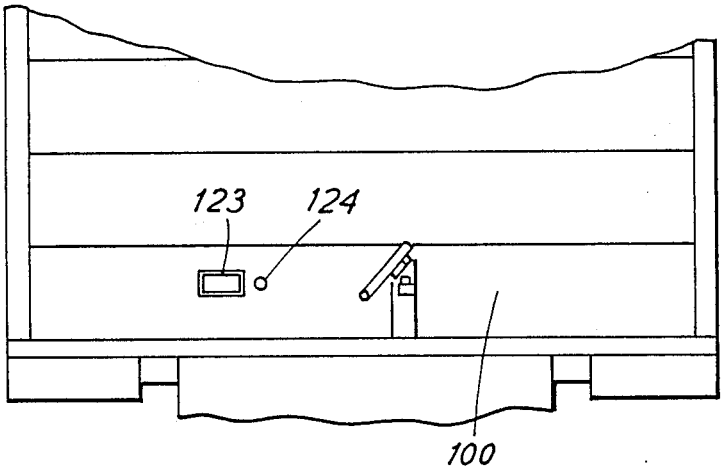
FIG. 7 is a partial view of the rear of the vehicle of FIG. 6.

In the embodiment shown in FIGS. 6 and 7, apparatus for recording the opening of the shutter 100 of a vehicle comprises a random number generator contained in a housing 121, a sensor 122 electrically connected to the random number generator and arranged to actuate the random number generator on opening of the shutter 100, and an LED display 123 arranged to display the last random number generated.

The random number generator, and a battery, are contained in the housing 121, which is mounted on the inner face of the shutter 100, so as to be visible through an aperture cut in the shutter 100. Alternatively, the display 123 may be mounted on the exterior face of the shutter and connected to the electronic circuits in the housing by leads passing through the shutter. A push button 124 is mounted next to the LED display, the display being actuated only when the button is depressed.

The sensor 122 consists of a switch or other suitable device mounted on the shutter 100 near one vertical edge, and an actuator 126 fixed to the vehicle body in such a position that the switch is actuated whenever the shutter 100 is opened or closed. The sensor 122 is connected to the electronic circuits in housing 121 by a flexible armoured conduit 127 fixed to the interior face of the shutter 100.

The electronic circuits in the housing 121 include a random number generator arranged to generate a random number on receipt of a signal from the sensor 122, to store the number until a new number is generated on receipt of the next signal from sensor 122, and to display the stored number on the LED display 123 on depression of the push-button 124. The electronic circuits may be similar to those of the embodiment of FIGS. 1 to 5 or may take any other suitable from, for example as described in United Kingdom patent application No. 8502857, from which the present application claims priority.

In use of the apparatus, after the vehicle has been loaded and the shutter closed, the button 124 is pressed, and the random number displayed is entered on the vehicle documents. At the destination, before the shutter is opened, the button is again depressed, and the number displayed is checked against the number entered on the documents, to ensure that the shutter has not been opened during the journey.

It will be appreciated that modifications could be made in the described embodiment. For example, the method of releasably attaching the free end of the cable to the housing could take different forms. The other end of the cable could be permanently attached to the housing in different ways or could be attached to the door or shutter near the housing, rather than to the housing itself. Instead of having one end permanently secured to the housing, both ends of the cable could be releasably attached to the housing. Instead of generating and displaying random numbers, other recognisable codes could be used, for example a series of letters.

I claim:

1. Apparatus for recording the operation of a closure member, comprising means for generating an electrical signal on actuation of an ancillary device associated with operation of the closure member, an electronic circuit for generating a random code, such as a random or quasi-random number on receipt of the electrical signal and for storing the generated code, and display means for displaying the generated code.

2. Apparatus as claimed in claim 1, and comprising a housing containing the electronic circuit and display means, an extending member attached at one end to the closure member and being linked to a catch of the closure member so that the extending member must be withdrawn from the catch before the closure member can be opened, and attachment means for releasably attaching the other end of said extending member to the housing, the means for generating an electrical signal being responsive to operation of the attachment means.

3. Apparatus as claimed in claim 1, and comprising a housing containing the electronic circuit and display means, an extending member attached at one end to the housing and being linked to a catch of the closure member so that the extending member must be withdrawn from the catch before the closure member can be opened, and attachment means for releasably attaching the other end of said extending member to the housing, the means for generating an electrical signal being responsive to operation of the attachment means.

4. Apparatus as claimed in claim 3, and adapted for use with a goods vehicle or container, in which the housing is adapted to be fixed to the outer face of the door or shutter of the vehicle or container, and the extending member is a flexible element which can be passed through the door or shutter catch before being engaged with the housing.

5. Apparatus as claimed in claim 3, in which the attachment means comprises a recess in the housing adapted to receive an enlarged head on the end of the extending member and a catch member movable on the housing between a clamping position in which the catch member prevents the head from being removed from the recess and a release position in which the head can be moved into and from the recess.

6. Apparatus as claimed in claim 5, in which the means for generating an electrical signal comprises a switch in the housing actuated on movement of the catch member from one of the said positions to the other.

7. Apparatus as claimed in claim 3, in which a battery for energizing the electronic circuit and the display means is mounted within the housing, and manually operated means are provided for causing actuation of the display means to display the code stored by the electronic circuit.

8. Apparatus as claimed in claim 7, in which said manually operated means comprises a push button mounted on the housing.

9. Apparatus as claimed in claim 1, in which the electronic circuit includes a free-running oscillator, a counter connected to the output of the oscillator, and means for storing the count of the counter at the instant the electrical signal is received, and in which said display means comprises a multi-digit display arranged to display the value of the stored count.

10. Apparatus for recording the operation of a closure member, comprising means for generating an electrical signal on operation of the closure member, an electronic circuit for generating a random code, such as a random or quasi-random number on receipt of the electrical signal and to store the generated code and display means for displaying the generated code.

11. Apparatus as claimed in claim 10, in which the means for generating the electrical signal comprises a sensor adapted to sense movement of the closure member to an opened or closed position.

12. Apparatus as claimed in claim 11, in which the electronic circuit is contained in a housing adapted to be mounted inside the space to be closed by the closure member, with the display means mounted so as to be visible from outside.

* * * * *

UNITED STATES PATENT AND TRADEMARK OFFICE

CERTIFICATE OF CORRECTION

PATENT NO. : 4,766,419

DATED : August 23, 1988

INVENTOR(S) : HAYWARD, Gilbert O.

It is certified that error appears in the above-identified patent and that said Letters Patent is hereby corrected as shown below:

Title page:

Correct the name of assignee as follows:

--Encrypta Electronics Limited--.

Signed and Sealed this

Thirtieth Day of May, 1989

*Attest:*

*Attesting Officer*

DONALD J. QUIGG

*Commissioner of Patents and Trademarks*